United States Patent [19]

Achenbach et al.

[11] 4,137,597

[45] Feb. 6, 1979

[54] ROLL CLEANING DEVICE

[75] Inventors: Karlheinz Achenbach; Dieter Brückel, both of Kaufbeuren, Fed. Rep. of Germany

[73] Assignee: Olympia Werke AG, Wilhelmshaven, Fed. Rep. of Germany

[21] Appl. No.: 854,221

[22] Filed: Nov. 23, 1977

[30] Foreign Application Priority Data

Nov. 25, 1976 [DE] Fed. Rep. of Germany ..... 2653519

[51] Int. Cl.[2] ..... G03G 21/00

[52] U.S. Cl. ..... 15/256.51

[58] Field of Search ..... 15/256.5, 256.51; 101/425; 355/15; 118/652

[56] References Cited

U.S. PATENT DOCUMENTS

| | | | |
|---|---|---|---|
| 2,382,214 | 8/1945 | Dunleavy | 15/256.51 |
| 3,792,925 | 2/1974 | Milligan | 355/15 |

*Primary Examiner*—Edward L. Roberts

*Attorney, Agent, or Firm*—Spencer & Kaye

[57] ABSTRACT

A cleaning device for wiping the cylindrical face of a roll supported for rotation has an elongated frame comprising a plurality of elongated support webs oriented at an angle to one another in a star-like configuration; a cleaning felt secured about the frame and supported by the free longitudinal edges of the support webs; pressing levers movably supported adjacent the roll and including a frame supporting arrangement for rotatably holding and positioning the frame at opposite ends thereof, parallel to the axis of the roll; and a spring connected to the pressing levers for urging the pressing levers towards the roll for pressing the frame against the roll into a working position. The cleaning felt is divided into a plurality of cleaning felt portions by any two neighboring free longitudinal edges. In the working position, one of the cleaning felt portions is urged into a shape-conforming engagement with the cylindrical face of the roll along the length thereof.

9 Claims, 2 Drawing Figures

ROLL CLEANING DEVICE

BACKGROUND OF THE INVENTION

This invention relates to a roll cleaning device, particularly for the fixing roll of a pressure fixing roll pair which serves for the fixing of a toner image formed of a toner powder made of a synthetic (plastic) material. The device finds particular application in an electrostatic copier and includes a cleaning felt impregnated with silicone oil.

Conventionally, in the direct or indirect electrostatic copying process, for the fixing of a developed image formed of a proper toner on a permanent record carrier, various fixing processes may be used. According to a known fixing process, the permanent record carrier (such as a paper sheet) is passed between a heated fixing roll and a pressure roll which is in engagement with the fixing roll. During this step the powder of the toner image is melted on the sheet and is caused to adhere thereto. This process, however, still has certain drawbacks. A portion of the toner sticks to the circumferential surface of the fixing roll which contacts the toner image; these adhered residues then are transferred to the consecutive record carrier, thus causing soiling thereof. In case the temperature of the fixing roll is too low, unmelted powder adheres thereto and is pressed, in an offset-like manner, onto the successive record carriers. If, on the contrary, the temperature of the fixing roll is too high, melted powder may adhere thereto and again, soil the successive sheets. In order to prevent such an offset soiling of the permanent record carriers, it is necessary to carefully control the fixing temperature. Such a control of the fixing temperature is, however, wrought with difficulties.

More recently, due to the availability of new toners, another fixing process has been introduced wherein the toner image is fixed without the use of heat by means of generating a sufficiently high pressure between the two rolls. In this process too, after the pressure fixing, a certain quantity of toner remains on the circumferential surface of the fixing roll which had contacted the toner image; these toner portions have to be removed as well, since the residual toner adhering to the fixing roll would again lead to the above-noted offset soiling of the record carriers.

It is known to arrange a silicone oil-impregnated cleaning felt in contact with the fixing roll to prevent the above-outlined offset soiling. The cleaning felt is conventionally formed of a thick felt strip which is inserted in a U-shaped holder and is immobilized on both sides. This arrangement is disadvantageous, in that the cleaning felt, as a whole, has a very limited continuous service life; thus, it has to be replaced very frequently. In the known device, however, the felt has to be replaced together with its holder to which it is firmly affixed. This circumstance adds substantially to the cost of the refill felts. Further, such a replacement needs particular skill; it thus cannot be performed by the user of the copier; it has to be effected by servicing personnel.

SUMMARY OF THE INVENTION

It is an object of the invention to provide an improved cleaning device for pressure fixing rolls wherein, in contradistinction to the known arrangements, the cleaning felt need not be replaced with the usual frequency and wherein its replacement can be performed by the consumer himself.

This object and others to become apparent as the specification progresses, are accomplished by the invention, according to which, briefly stated, the cleaning device for wiping the cylindrical face of a roll supported for rotation has an elongated frame comprising a plurality of elongated support webs oriented at an angle to one another in a star-like configuration; a cleaning felt secured about the frame and supported by the free longitudinal edges of the support webs; pressing levers movably supported adjacent the roll and including a frame supporting arrangement for rotatably holding and positioning the frame at opposite ends thereof, parallel to the axis of the roll; and a spring connected to the pressing levers for urging the pressing levers towards the roll for pressing the frame against the roll into a working position. The cleaning felt is divided into a plurality of cleaning felt portions by any two neighboring free longitudinal edges. In the working position, one of the cleaning felt portions is urged into a shape-conforming engagement with the cylindrical face of the roll along the length thereof.

The cleaning device structured according to the invention excels by its simple structure and by providing for a simple replaceability of the cleaning felt. It is of particular advantage that the replacement of the cleaning felt may be effected easily and in a short time even by lay persons.

DESCRIPTION OF THE PREFERRED EMBODIMENT

Figure 1:
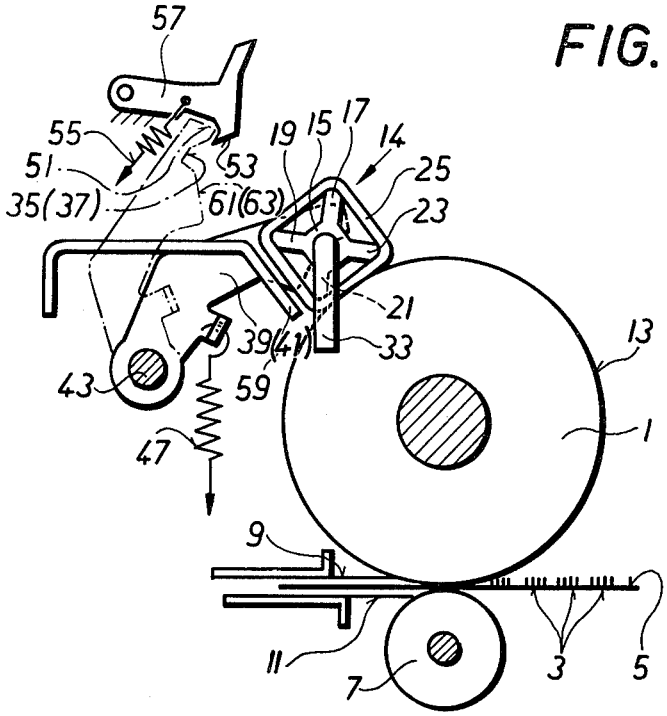
FIG. 1 is a schematic side elevational view of a preferred embodiment of the invention.
Figure 2:
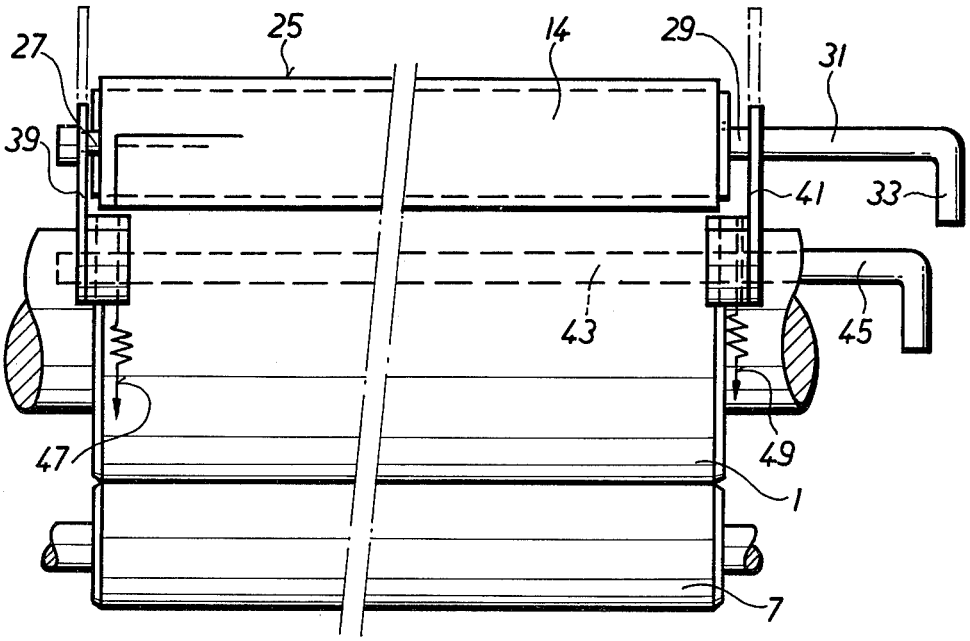
FIG. 2 is a top plan view of the same embodiment.

Turning now to the Figures, there is illustrated a cleaning device for a pressure fixing roll pair incorporated in an electrostatic copier. An image formed of a toner material 3 is fixed by pressure on a record carrier 5 as the latter is passed between a fixing roll 1 and a backup pressure roll 7 which is in engagement with the fixing roll 1. The record carrier 5, with the fixed toner image thereon, is separated from the pressure fixing roll 1 and the backup pressure roll 7 by means of strippers 9 and 11 and is withdrawn from the copier. During the fixing process, as the fixing roll 1 contacts the toner image on the record carrier, a certain amount of the toner is transferred to the cylindrical face 13 of the fixing roll and remains adhered thereto. This residual toner is, in turn, removed by the cleaning device structured according to the invention and now to be described.

The cleaning device according to the invention has a cleaning roll 14 which comprises a frame 15 formed of four support webs 17, 19, 21 and 23 arranged at 90° with one another and having a length dimension which extends parallel to the axis of the fixing roll 1. The frame 15 thus has a star-like configuration when viewed from an end. A cleaning felt 25 is tautly mounted about the support webs and is thus in firm engagement with the outer longitudinal edge of each support web. The cleaning felt may be a seamed or seamless hose or a flat strip helically wound about the support webs 17, 19, 21 and 23.

The frame 15 has, at its opposite ends, axially projecting stub shafts 27 and 29. The free end portion 33 of the stub shaft 29 is angularly bent to thus form a cranking handle 31, 33. In the working position of the cleaning roll 14, the stub shafts 27 and 29 are staddled by bearing notches 35 and 37 of respective pressing levers 39 and 41 which are affixed to a shaft 43 rotatably supported in the copier. One end of the shaft 43 is formed as a manually engageable handle 45. The pressing levers 39 and 41 are urged clockwise (as viewed in FIG. 1) by respective individual springs 47 and 49 in such a manner that the cleaning roll 14, with the cleaning felt 25, is pressed against the cylindrical surface 13 of the fixing roll 1. The cleaning felt 25 is pressed by the spring-biased pressing levers 39 and 41 in such a manner against the fixing roll 1 that the portion of the cleaning felt 25 which extends between two circumferentially adjoining support webs and which is oriented towards the fixing roll 1 conforms to the cylindrical curvature of the fixing roll 1. As the latter rotates during operation, the portion of the cleaning felt 25 pressed into engagement with the fixing roll 1 wipes the cylindrical surface 13 thereof by sliding friction to thus remove the residual toner which the fixing roll picked up from the record carrier during the pressure fixing step. Advantageously, the cleaning felt 25 is impregnated with silicone oil to thus apply an oil film to the fixing roll 1. The silicone oil film reduces the tendency of the toner to adhere to the fixing roll and thus reduces soiling thereof.

After the portion of the cleaning felt 25 which is in contact with the cylindrical face 13 of the fixing roll 1 has become soiled, a new clean felt portion can be brought to the operational (working) position by a simple rotation of the cleaning roll 14 through 90° by manually turning the cranking handle 31, 33. If such a rotary motion is effected clockwise as viewed in FIG. 1, it is the new felt portion which extends between the support webs 17 and 19 that will arrive into the working position. In this manner, the felt portions between the webs 17 and 19 as well as 19 and 21 can be successively brought into contact (working position) with the cylindrical surface 13 of the fixing roll 1. After using all four felt portions which extend, respectively, between the support webs 17, 19; 19, 21; 21, 23 and 23, 17, the pressing levers 39 and 41 are brought into their dash-dotted position shown in FIG. 1 by manually turning counterclockwise the cranking handle 45 of the shaft 43. During this occurrence, a latch portion 51 of the pressing lever 39 falls behind a detent 53 of a pivotal locking lever 57 biased by a tension spring 55. The pressing levers 39 and 41 are thus held in their inoperative (open) position, out of engagement with the stub shaft 27 and 29 of the cleaning roll 14. The thus released cleaning roll 14 is, at this time, supported by a support shelf 59 extending parallel to the fixing roll 1. Thereafter, the entire cleaning roll 14 may be pulled out laterally of the copier by the handle 31. The support shelf 59 prevents the cleaning roll 14 from dropping subsequent to its release from the pressing levers 39 and 41 and furthermore makes possible a reintroduction of the cleaning roller 14 in its at least approximately correct operational position. Subsequent to removing the cleaning roll 14, the cleaning felt 25 is pulled off the frame 15. Thereafter a new cleaning felt 25 is mounted on the frame 15 and then the cleaning roll 14 is re-inserted into the copier. During this occurrence, the cleaning roll 14 lies on the cylindrical face 13 of the fixing roll 1 and is also supported by the support shelf 59. Subsequently, the pressing levers 39 and 41 are released by pivoting the locking lever 57 counterclockwise (as viewed in FIG. 1) against the force of the spring 55 and are allowed, under the effect of the springs 47 and 49, to pivot clockwise about the axis of the pivot shaft 43. During this pivotal motion, first the oblique lead-in or camming edges 61 and 63 of the pressing levers 39 and 41, respectively, arrive into engagement with the respective stub shafts 27 and 29 of the cleaning roll 14. The cleaning roll 14 is then, by camming effect, displaced beyond the lead-in edges 61 and 63 to such an extent on the cylindrical face 13 of the fixing roll 1, until the stub shafts 27, 29 nest in the bearing notches 35 and 37, respectively. At the same time, the cleaning roll 14 has moved away from the support shelf 59 to such an extent that in its operative position it may be rotated by the cranking handle 31, 33 without any obstruction. Thus, by means of pivoting downwardly (as viewed in FIG. 1) the pressing levers 39, 41, there is achieved an automatic centering of the cleaning roll 14 which will thus assume its correctly supported, operative position. The pressing levers 39 and 41 also block the cleaning roll 14 in the axial direction.

It will be understood that the above description of the present invention is susceptible to various modifications, changes and adaptations, and the same are intended to be comprehended within the meaning and range of equivalents of the appended claims.

What is claimed is:

1. In a cleaning device for wiping the cylindrical face of a roll supported for rotation; the improvement comprising:

(a) an elongated frame comprising a plurality of elongated support webs oriented at an angle to one another in a star-like configuration; each support web having a free longitudinal edge;

(b) a cleaning felt secured about said frame and supported by the free longitudinal edges of the support webs; said cleaning felt being divided into a plurality of cleaning felt portions by any two neighboring free longitudinal edges;

(c) pressing levers movably supported adjacent said roll and being displaceable into a working position and a withdrawn position; said pressing levers including frame supporting means for rotatably holding and positioning said frame at opposite ends thereof, parallel to the axis of said roll in said working position of said pressing levers; and (d) spring means connected to said pressing levers for urging said pressing levers towards said roll for pressing said frame, held in said frame supporting means, against said roll into an operating position; in said operating position one of said cleaning felt portions being urged into a shape-conforming engagement with said cylindrical face of said roll along the length thereof.

2. A cleaning device as defined in claim 1, wherein the support webs are four in number and are offset at 90° to one another.

3. A cleaning device as defined in claim 1, wherein said cleaning felt has a hose-like configuration; said cleaning felt is replaceably secured to said frame.

4. A cleaning device as defined in claim 1, further comprising a manually engageable cranking handle for rotating said frame.

5. A cleaning device as defined in claim 1, further comprising a support shelf held stationarily and parallel to the roll adjacent the cylindrical surface thereof for supporting said frame in the withdrawn position of said pressing levers; stub shafts affixed to opposite ends of said frame and extending away therefrom; each said pressing lever having a bearing notch receiving the respective stub shaft in said working position; the bearing notches constituting said frame supporting means; each pressing lever further having a camming edge disposed adjacent the respective bearing notch for engaging the respective said stub shaft and displacing said frame from its supported position on said support shelf into said bearing notches when said pressing levers are moved from said withdrawn position into said working position.

6. A cleaning device as defined in claim 1, further comprising a common pivot shaft carrying said pressing levers for swingably supporting said pressing levers; a manually engageable cranking handle attached to said common pivot shaft for swinging said pressing levers from one of their positions into the other; and locking means for retaining said pressing levers in said withdrawn position against the force of said spring means.

7. A cleaning device as defined in claim 6, wherein said locking means includes a latch portion provided on at least one of said pressing levers and a stationarily supported, spring-biased locking lever having a detent cooperating with said latch portion.

8. A cleaning device as defined in claim 1, wherein said roll is a fixing roll of a pressure fixing roll pair for fixing a toner image on a record carrier.

9. In a cleaning device for wiping the cylindrical face of a roll supported for rotation; the improvement comprising:

(a) an elongated frame comprising a plurality of elongated support webs oriented at an angle to one another in a star-like configuration; each support web having a free longitudinal edge;

(b) a cleaning felt secured about said frame and supported by the free longitudinal edges of the support webs; said cleaning felt being divided into a plurality of cleaning felt portions by any two neighboring free longitudinal edges; and (c) positioning and pressing means for positioning and pressing said frame against said roll into an operating position; in said operating position one of said cleaning felt portions being urged into a shape-conforming engagement with said cylindrical face of said roll along the length thereof.

* * * * *